US006953212B2

(12) United States Patent
Alba

(10) Patent No.: US 6,953,212 B2
(45) Date of Patent: Oct. 11, 2005

(54) WELD MOUNT HOIST RING

(75) Inventor: Tony J. Alba, West Covina, CA (US)

(73) Assignee: CBC Industries, Inc., Pico Rivera, CA (US)

( * ) Notice: Subject to any disclaimer, the term of this patent is extended or adjusted under 35 U.S.C. 154(b) by 0 days.

(21) Appl. No.: 10/167,161

(22) Filed: Jun. 11, 2002

(65) Prior Publication Data

US 2002/0185873 A1 Dec. 12, 2002

Related U.S. Application Data

(60) Provisional application No. 60/297,287, filed on Jun. 11, 2001.

(51) Int. Cl.[7] ..... B66C 1/10

(52) U.S. Cl. ..... 294/1.1; 294/82.1; 403/78; 403/164

(58) Field of Search ..... 294/1.1, 82.1, 294/89; 403/78, 79, 119, 164; 410/101, 106

(56) References Cited

U.S. PATENT DOCUMENTS

| | | | | |
|---|---|---|---|---|
| 3,831,532 A | | 8/1974 | Smith et al. | |
| 4,570,987 A | | 2/1986 | Wong et al. | |
| 4,641,986 A | | 2/1987 | Tsui et al. | |
| 4,705,422 A | | 11/1987 | Tsui | |
| 5,248,176 A | * | 9/1993 | Fredriksson | 294/1.1 |
| 5,393,164 A | * | 2/1995 | Renner et al. | 403/271 |
| 5,405,210 A | | 4/1995 | Tsui | |
| 5,586,801 A | | 12/1996 | Sawyer et al. | |
| 5,848,815 A | | 12/1998 | Tsui et al. | |
| 6,231,267 B1 | * | 5/2001 | Pearl | 404/25 |
| 6,547,474 B1 | * | 4/2003 | Smetz | 403/78 |

* cited by examiner

*Primary Examiner*—Dean J. Kramer
(74) *Attorney, Agent, or Firm*—Bruce A. Jagger

(57) ABSTRACT

A hoist ring assembly adapted to be arc welded directly to an object to be lifted. A hoist ring mount is provided with the assembly having a generally radially extending flange portion integral with the proximal end of a generally cylindrically bearing portion. The perimeter of the flange portion is welded directly to an object to be lifted by means of a peripheral weld boundary. The bearing portion has a circumference. The length of the peripheral weld boundary is greater than the length of the circumference, thereby reducing stresses applied across the weld while maintaining the load capacity of the assembly after welding. A conventional lifting loop is pivotally mounted to a collar member. The collar member is rotatably mounted on the cylindrical bearing portion of the hoist ring mount. The lifting loop assembly, comprising the lifting loop and the collar member, is detachably mounted on the welded-in-place hoist ring mount. This attachment may be through an internal or external threaded mount, or a quick release detent-locking element configuration.

8 Claims, 5 Drawing Sheets

PRIOR ART

WELD MOUNT HOIST RING

This application claims the benefit of U.S. Provisional Application No. 60/297,287 filed Jun. 11, 2001.

BACKGROUND OF THE INVENTION

1. Field of the Invention

The invention relates in general to hoist ring assemblies and, in particular, to a weld mounted hoist ring assembly with a flanged bushing, wherein the perimeter of the flange is welded directly to the surface of an object to be lifted.

2. Description of the Prior Art

Various hoist ring assemblies had been proposed previously. Typically, such hoist ring assembles were designed to threadably engage an object to be lifted. For example, the hoist ring assemblies in Tsui et al U.S. Pat. No. 5,848,815, in Tsui et al U.S. Pat. No. 4,705,422, in Tsui et al U.S. Pat. No. 4,641,986, in Tsui U.S. Pat. No. 5,405,210, and in Wong et al U.S. Pat. No. 4,570,987 all had a protruding mounting screw for threadably engaging an object to be lifted. Generally, to accommodate such prior screw mounted hoist ring assemblies the object must be drilled and tapped to the appropriate thread size and depth before installation. Importantly, it is critical for safety purposes that the depth of the threaded hole is sufficient to provide the proper amount of thread engagement for the hoist ring screw. If the depth is insufficient, catastrophic failure may occur. Thus, hoist ring assemblies with protruding mounting screws are generally unsatisfactory for use in situations where the thickness of the object to be lifted is insufficient to provide enough thread engagement, or, as in watercraft, where holes in the object are undesirable.

Previous expedients proposed for the weld mounting of hoist rings involved a conventional stud welding operation to affix a stud to a metal object. The welded stud replaced the conventional threaded mounting screw. See Sawyer et al. U.S. Pat. No. 5,586,801. The strength of a mounted hoist ring assembly depends in significant part on the mounting structure bearing firmly and uniformly on the load. Any misalignment of a welded mounting stud would prevent this and greatly weaken the mounted assembly. Any weakening of the object by the heat or imperfection of the welding operation is unpredictable so a safety limit for the capacity of the assembly can not be reliably established. The quality of the weld has a great impact of the strength of the system. The weld is concentrated at the end of the stud in a small area, so the loads are likewise concentrated in this small area. The weld mounting of hollow retainer plates for load anchors with limited movement had been proposed. See Smith et al. U.S. Pat. No. 3,831,532.

Previously, difficulties had been anticipated in attempting to weld mount hoist ring assemblies directly to objects to be lifted. Welding had been believed to introduce uncertainty into the resulting load capacity of a hoist ring. For instance, the heat added during welding may destroy the underlying strength of the system. The characteristics of the object have an influence on the strength of the weld. It had been proposed to supply pre-drilled and tapped mounting plates for use with conventional screw mount hoist ring assemblies. These mounting plates were welded directly to the surface of the object to be lifted. The hoist ring assemblies were then threadably mounted to the welded plates. However, due to the wide variety of hoist rings assemblies and their associated lift ratings, a large inventory of various sized, pre-drilled and tapped plates was found to be necessary. Maintaining such an inventory is not only undesirable, but also increases the chances of mismatching an incorrect plate size or capacity for a given hoist ring assembly. Such mismatches are undesirable and can result in catastrophic failure.

Thus, there is a need to provide hoist ring assemblies capable of lifting heavy objects having relatively thin surfaces or surfaces that should not be perforated for attaching the assemblies. There is also a need for such assemblies to be self-contained thereby eliminating the chances of mismatching separately provided threaded plates with conventional screw mount hoist ring assemblies. Those concerned with these problems recognize the need for an improved self-contained hoist ring assembly, one capable of being welded directly to an object to be lifted. The design of the weld must be such that the strength of the resultant weld is reliably and predictably greater than the underlying load rating of the hoist ring assembly so that the weld does not reduce the load rating capacity of the hoist ring assembly.

BRIEF SUMMARY OF THE INVENTION

A preferred embodiment of the weld mount hoist ring assembly according to the present invention comprises a hoist ring mount adapted to be welded to the surface of an object to be lifted. The hoist ring mount has a generally radially extending flange portion integral with the proximal end of a bearing portion. The bearing portion is adapted to detachably accept a lifting loop for rotational and pivotal movement. The flange portion has an obverse face that is adapted to being positioned flat against the surface of the object to be lifted. The opposed reverse face of the flange is adjacent the generally cylindrical surface of the bearing portion of the mount. The obverse and reverse faces are joined at their peripheries by a perimeter portion.

The perimeter portion provides a peripheral weld boundary, which is adapted to being arc welded to the surface of the object. Arc welding minimizes the amount of heat that is applied to the hoist ring mount. The bearing portion includes a peripheral bearing boundary. The length of the peripheral weld boundary is greater than the length of the peripheral bearing boundary in order to reduce the stresses applied to the weld when the object is lifted. The flange also serves to space the collar member from the weld so that it is free to rotate about the bearing portion. The peripheral weld boundary is generally at least one and one quarter, and, preferably, at least about twice to three and one half or more times greater than the length of the peripheral bearing boundary. The length of the weld boundary, as determined by the length of the perimeter portion, is such that it eliminates the weld as being the weak link in establishing the load capacity of the assembly. Even if there is an imperfection in the weld, there should be enough good weld to support the load. Placing the heat of the weld out on the perimeter of the flange away from the body of the mount protects the body from unpredictable heat induced property changes. Also, since it is known that the perimeter portion will be subjected to heat, the worst case for heat induced weakening of the flange portion can be taken into consideration in designing safety factors into the mount. Increasing the length of the perimeter portion, or the thickness of the flange, or both can usually compensate for the effect of heat induced weakening.

Hoist rings are generally designed to withstand loads of up to five times their rated capacity. Typically, the weakest link in the system is the pivoting structure or the mounting structure, and they typically fail in shear. The strength of the weld, assuming an average weld, and the worst case for heat induced weakening of the flange portion, should be such that it exceeds the rated load of the hoist ring by a factor of at least about 5.1, and, preferably at least about 5.5. For example, the design strength of a weld for a hoist ring with a rated load of 10,000 pounds should be at least 51,000 pounds.

Preferably, the hoist ring mount is arc welded to the surface of an object to be lifted with the remaining parts of the assembly temporarily removed. This minimizes the heat to which the various rotating and pivoting parts are subjected during the welding process. After welding, the parts are re-assembled and the object is ready for lifting. The hoist ring mount can be adapted for use with a wide variety of different hoist ring assemblies.

To acquaint persons skilled in the pertinent arts most closely related to the present invention, a preferred embodiment of a weld mounted hoist ring that illustrates a best mode now contemplated for putting the invention into practice is described herein by, and with reference to, the annexed drawings that form a part of the specification. The exemplary weld mounted hoist ring assembly is described in detail without attempting to show all of the various forms and modifications in which the invention might be embodied. As such, the embodiments shown and described herein are illustrative, and as will become apparent to those skilled in the arts, can be modified in numerous ways within the scope and spirit of the invention, the invention being measured by the appended claims and not by the details of the specification.

BRIEF DESCRIPTION OF THE DRAWINGS

The present invention provides its benefits across a broad spectrum of hoist ring assemblies. While the description which follows hereinafter is meant to be representative of a number of such applications, it is not exhaustive. As those skilled in the art will recognize, the basic apparatus taught herein can be readily adapted to many uses. It is applicant's intent that this specification and the claims appended hereto be accorded a breadth in keeping with the scope and spirit of the invention being disclosed despite what might appear to be limiting language imposed by the requirements of referring to the specific examples disclosed.

Referring particularly to the drawings for the purposes of illustration only and not limitation.

DETAILED DESCRIPTION OF THE PREFERRED EMBODIMENTS

Figure 1:
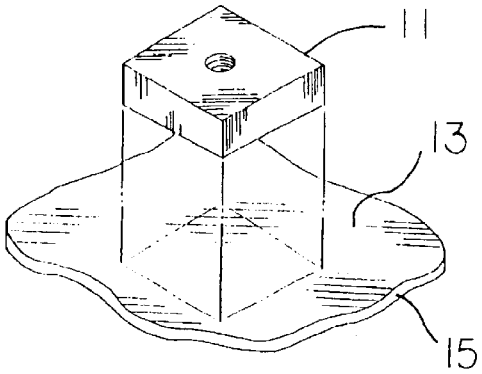
FIG. 1 is an exploded perspective view of a prior art drilled and tapped weld block used in conjunction with conventional screw-type hoist ring assembly.

Referring now to the drawings, like reference numerals designate identical or corresponding parts throughout the several views.

Figure 2:
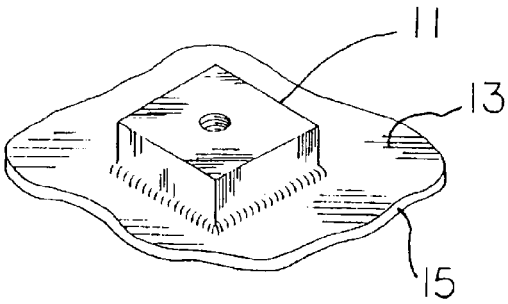
FIG. 2 is a perspective view of the prior art weld block of FIG. 1 after being arc welded to the surface of an object to be lifted.

In FIGS. 1 and 2 there is shown at 11 a pre-drilled and threaded mount plate of the prior art to be used in conjunction with conventional screw mount hoist ring assemblies. The pre-drilled and threaded mount plate 11 is welded to the surface 13 of object 15, as shown in FIG. 2. The pre-drilled and threaded mount plate had been believed necessary to provide a sufficient thread engagement for conventional hoist ring assemblies when, for example, the thickness of the surface of the object is too thin. For example, a one inch hoist ring assembly rated to lift 10,000 pounds requires a thickness of about one inch in the object to be lifted in order to provide enough thread engagement. Objects having less than this thickness had previously been believed to require the predrilled and threaded mount plate 11. Providing pre-drilled and threaded mount plates for use with conventional screw mounted hoist ring assemblies has many disadvantages. A large inventory of various sizes and thickness of such threaded plates must be maintained to satisfy a wide variety of lifting applications. Such an inventory creates the possibility of selecting the incorrect plate for a given application, which can result in catastrophic failure. These and other difficulties are overcome according to the present invention.

Referring particularly to FIGS. 5 through 8, there is illustrated generally at 10 a weld mount hoist ring assembly of the present invention. The weld mount hoist ring assembly 10 comprises a hoist ring mount 12 that is to be welded directly to the surface 13 of an object 15. The purpose of the assembly is to lift object 15.

Figure 3:
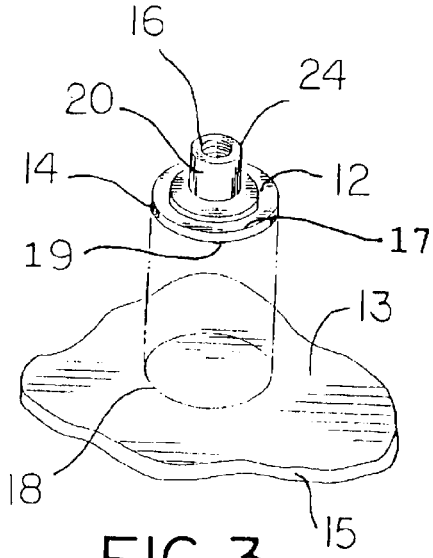
FIG 3 PRIOR ART
FIG. 3 is an exploded perspective view of a preferred embodiment of a hoist ring mount according to the present invention wherein an internal thread is provided for rotatably and pivotally attaching a lifting loop assembly to the mount.
Figure 4:
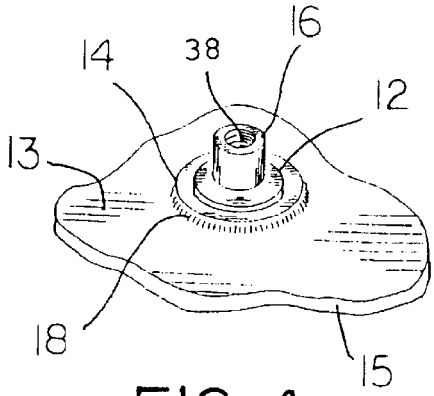
FIG. 4 is a perspective view of the embodiment of FIG. 3 after the peripheral boundary of the radially extending flange portion of the hoist ring mount has been arc welded to the surface of an object to be lifted.

Referring particularly to FIGS. 3 and 4, the hoist ring mount 12 has a generally radially extending flange portion 14 that is integral with a bearing portion 16. Flange portion 14 includes obverse face 15 and opposed reverse face 17. Reverse face 17 is adjacent external bearing surface 20. The obverse face 17 of flange portion 14 is placed directly on the surface 13 of the object 19. The obverse and reverse faces of flange portion 14 are peripherally joined by a perimeter portion. The perimeter portion, as shown particularly in FIG. 4, is welded in place on the surface 13 of object 15 by peripheral weld boundary 18.

As shown, for example, in FIGS. 3 and 4, the hoist ring mount 12 includes a bearing portion 16 that includes an external bearing surface 20 and internal threaded portion 38. External bearing surface 20 is adapted to rotatably and pivotally mount a lifting loop assembly between its proximal end, where the flange portion 14 is mounted, and its distal end where the internal threaded portion 38 opens. An axis extends between the proximal and distal ends. The internal threaded portion 38 is adapted to threadably receive the mounting screw of a conventional hoist ring assembly. External bearing surface 20 is circumscribed by a peripheral bearing boundary 24. It has been found advantageous in this preferred embodiment that the length of the peripheral weld boundary 18 be, for example, at least approximately the length of the peripheral bearing boundary 24. This distributes the stresses in the weld when a lifting load is applied. In addition, this separates the area of the weld on the flange from the bearing portion of the mount so the heat from the welding process does not adversely effect the material of the bearing portion. The length of the peripheral weld boundary 18 should be at least sufficiently greater than the peripheral bearing boundary 24 to provide a weld that is at least as strong as the other elements of the assembly. Although the shape of the peripheral weld boundary is illustrated as being generally circular, other shapes can be used, for example oval, square, polygon, and the like.

Figure 7:
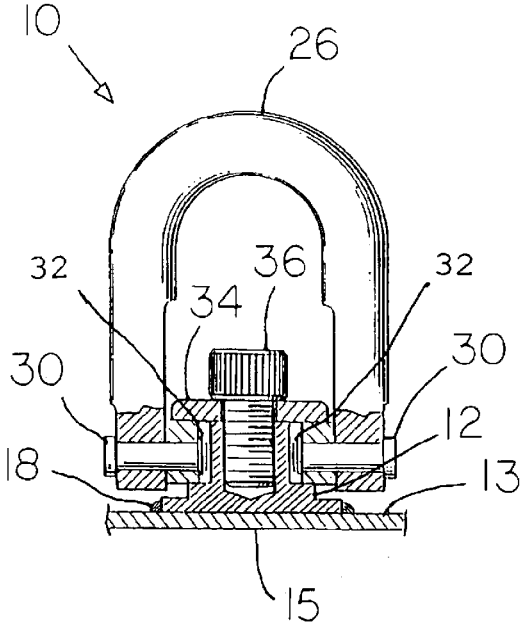
FIG. 7 is a partial cross-sectional side elevational view of another preferred embodiment.
Figure 8:
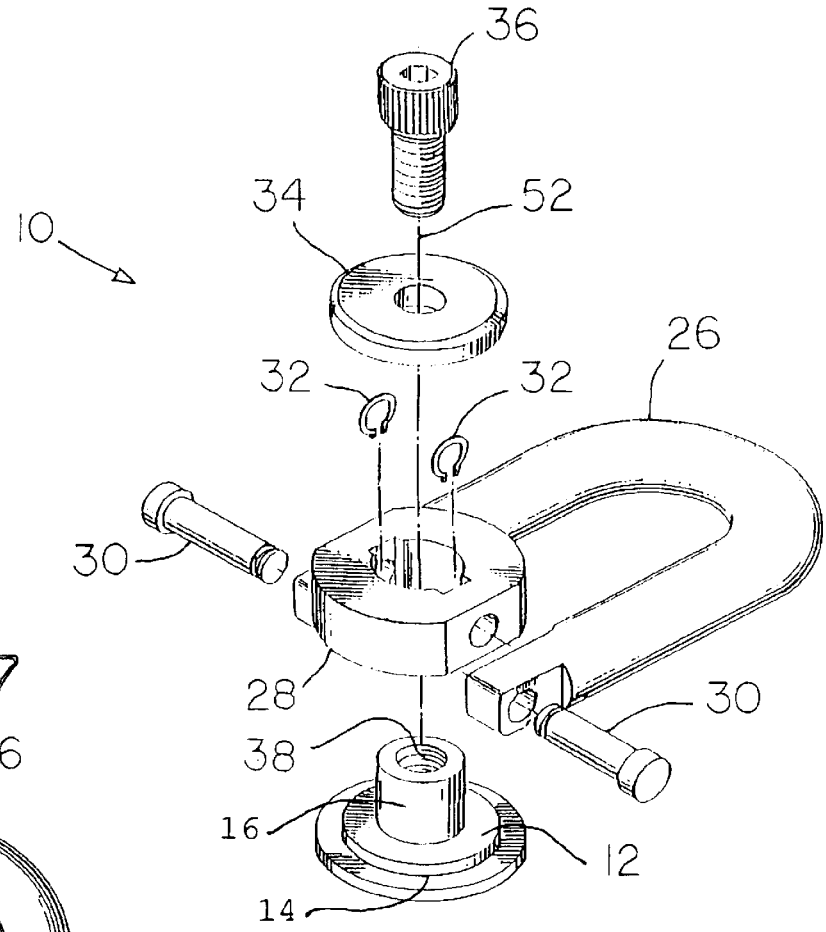
FIG. 8 is an exploded perspective view of the preferred embodiment shown in FIG. 7.

A preferred embodiment of the present invention is shown particularly in FIGS. 7 and 8 wherein the hoist ring mount is adapted with parts of a hoist ring assembly as disclosed in Tsui et al. U.S. Pat. No. 4,705,422, which Tsui et al. patent is hereby incorporated herein by reference. This embodiment includes lifting loop 26 in pivotal engagement with a collar member 28 via pins 30, which pins are retained in place by retainer clips 32. A load washer 34 and retainer screw 36 are provided. The retainer screw engages the internal threaded portion 38 of hoist ring mount 12 and is tightened down against the load washer 34. The bearing portion of the collar member 28 between its distal and proximal ends along axis 52 is slightly longer than the thickness of collar member 28. With the retainer screw 36 fully tightened in internal threaded portion 38, the collar member 28 is left free to rotate about the bearing portion of hoist ring mount 12. Flange portion 12 provides for the separation of the collar member 28 from the weld. The weld is thus prevented from interfering with the rotation of collar member 28. The reverse face of flange portion 12 is provided with a raised boss against which the mating face of collar member 28 turns. Importantly, the torque settings for the retainer screw 36 are less critical than for an equivalent sized prior art screw mount hoist assembly, because the shear stresses are not localized across the screw. Also, unlike conventional screw mounted hoist rings, if the obverse face of flange 14 is not exactly flat against the surface of the load, it is generally of no significant concern, because the loads are transmitted through the weld. Unexpectedly, it has been discovered that the weld mount hoist ring of the present invention, as compared to an equivalent size prior art screw mount hoist assembly, requires a lower installation torque setting and can support greater lifting loads.

Installation of the embodiment of FIGS. 7 and 8 is achieved by removing screw 36 to free the hoist ring mount 12 from the lifting loop assembly. The entire lifting loop assembly, including the lifting loop and the collar member, is removed from mount 12. The hoist ring mount 12 is then arc welded along its perimeter portion to the surface of the object. This assures the parts of the assembly, other than the hoist ring mount 12, are not effected in any way by the heat of the welding process. The ability to disassemble the hoist ring mount from the lifting loop assembly thus contributes significantly to the safety of the system. The parts of the lifting loop assembly are then re-positioned about the hoist ring mount, screw 36 is installed and brought to its appropriate torque value.

Figure 5:
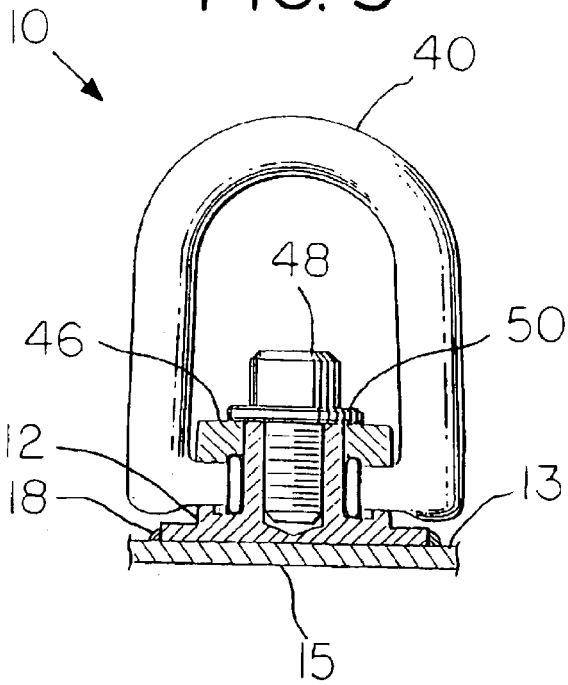
FIG. 5 is a partial cross-sectional side elevational view of a preferred embodiment.
Figure 6:
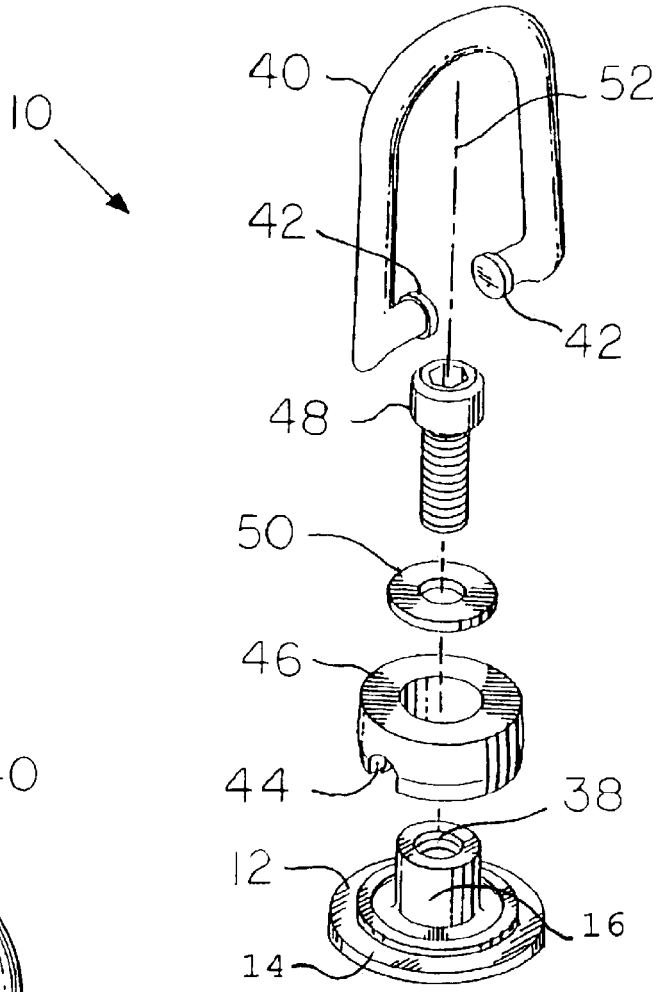
FIG. 6 is an exploded perspective view of the preferred embodiment shown in FIG. 5.

Another embodiment of the present invention is shown particularly in FIGS. 5 and 6. In this embodiment the hoist ring mount 12 is adapted for use with the parts of the hoist ring assembly as disclosed in Tsui U.S. Pat. No. 5,405,210. This Tsui et al. patent is hereby incorporated herein by reference. In this embodiment, the hoist ring assembly 10 includes a forged hoist ring or lifting loop 40 having two integral stub shaft members 42 pivotally engaged in retainer recesses 44 of a collar member 46. A retainer screw 48 and load washer 50 complete the assembly as the retainer screw engages the internal threaded portion 38 of the hoist ring mount 12. The lifting loop assembly rotates generally about axis 52. The reverse face of the flange portion 14 is configured with a grooved boss. The grooved boss serves to engage and retain the enlarged ends of the stub shaft members 42. The collar member 46 rotates about the bearing member 16 and lifting loop 40 pivots about stub shaft members 42.

Figure 9:
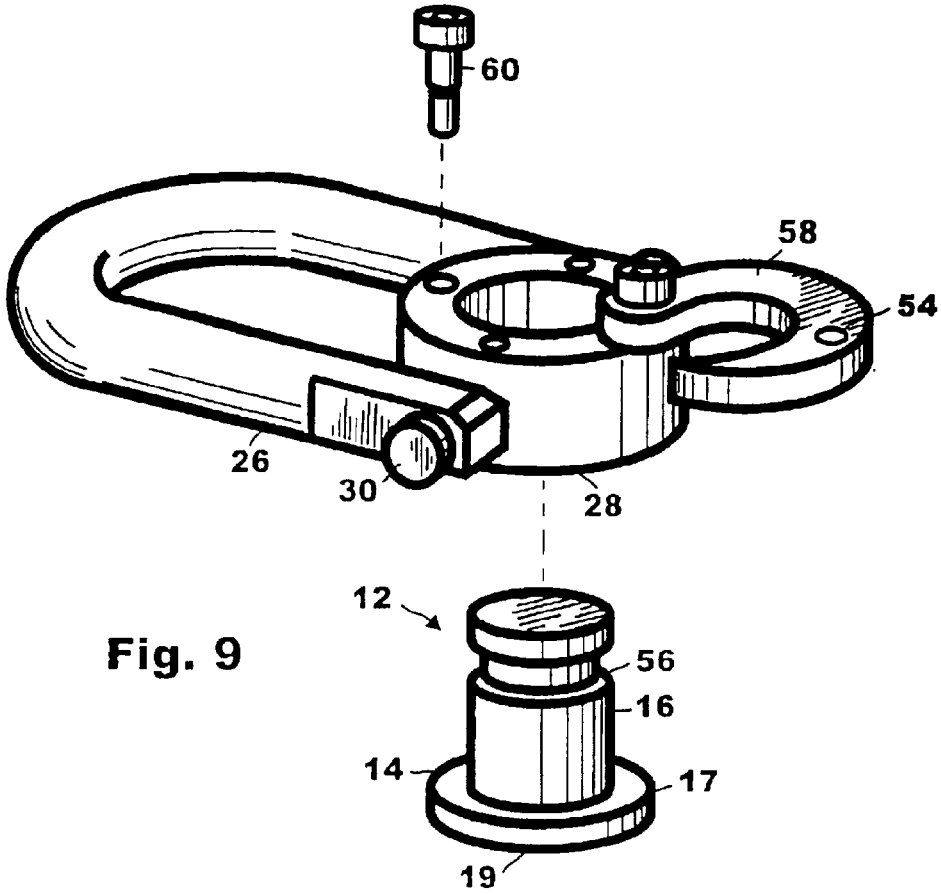
FIG. 9 is an exploded perspective view of a preferred embodiment wherein a quickly detachable lifting loop assembly includes a detent element for engagement in an annular groove in the hoist ring mount.

In the embodiment illustrated particularly in FIG. 9, a hoist ring mount indicated generally at 12 includes a generally radially extending flange portion 14, the reverse face 17 of which is integral with the proximal end of generally circular bearing member 16. The obverse face 19 of flange portion 14 is adapted to being positioned against the surface of an object that is to be lifted. The obverse face 15 is joined to reverse face 17 through a peripheral portion. This peripheral portion is adapted to being welded to the surface of the object. For the purposes of illustration, the length of the peripheral portion has been illustrated as being less than about twice the circumference of the bearing portion. It will be understood that the length of the peripheral portion can be made 2 or 3 or more times the circumference of the bearing portion, as may be desired. The lifting loop assembly resembles that depicted in FIGS. 7 and 8 except that a first end of a generally C-shaped detent element 54 is pivotally attached to the distal face of collar member 28 for movement in a plane that is generally normal to the longitudinal axis of the system. The throat 58 of C-shaped detent element 54 is positioned to move between an engaged and an unengaged configuration with a locking element in the form of annular groove 56 in bearing portion 16. A pin 60 is provided for insertion through the second end of C-shaped detent element 54 and Into the body of collar member 28 when throat 58 is engaged with annular groove 56. Pin 60 retains the detent element in engaged position with the locking element. The collar member 28 is free to rotate around the bearing portion 16, and the lifting loop 26 is free to pivot about pins 30. The throat 58 remains engaged with the locking element as the collar member rotates. Freeing pin 60 from engagement with collar member 28 permits the detent element to disengage from the locking element. The lifting loop assembly can then be removed from the hoist ring mount. When a quick hand releasable pin is used, the lifting loop assembly can be removed and replaced without the use of any tools. The bearing portion 16 has the advantage of being solid. Other lifting loops, such as, for example, that illustrated in FIGS. 5 and 6 can also be used with quick disconnect detent and locking elements.

Figure 10:
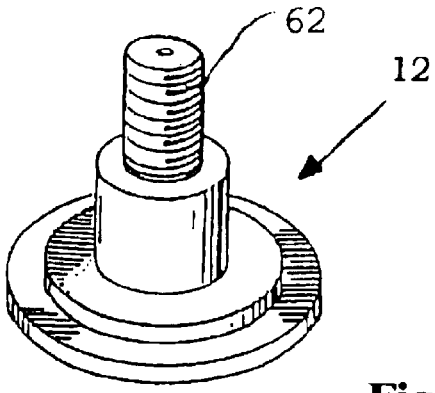
FIG. 10 is a perspective view of an embodiment of a hoist ring mount according to the present invention wherein an externally threaded mounting member is provided.

The hoist ring mount embodiment of FIG. 10 is similar to that of FIG. 3 except that an external threaded portion 62 is provided for the mounting of the lifting loop assembly. A nut, not illustrated, is drawn down against a thrust washer to hold a lifting loop assembly on the hoist ring mount.

Figure 11:
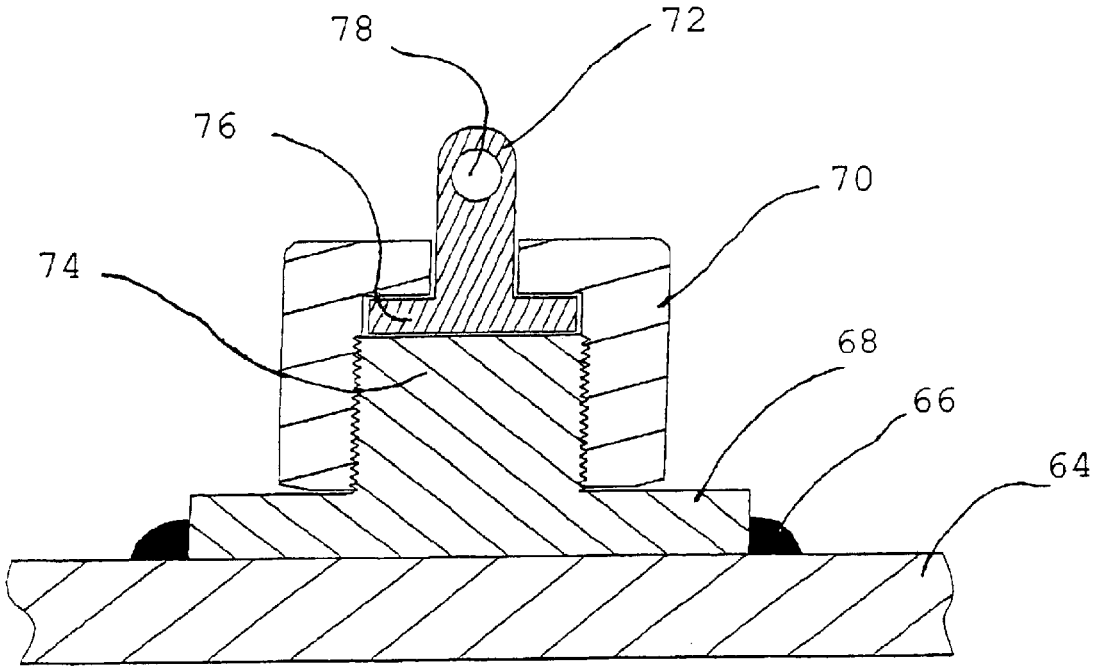
FIG. 11 is a cross-sectional view of a further embodiment of the present invention wherein a circular disk is rotatably trapped within an annular cavity formed between a generally hat-shaped member and a threaded cap.

The hoist ring mount of FIG. 11 is a generally hat-shaped member having an annular flange 68 that is welded at 66 to the surface of a substrate 64. A centrally located threaded stud 74 is threadably engaged with a cap member 70, which together with a generally annular disk 76 and stem 72 forms a lifting loop assembly. Generally annular disk 76 is rotatably trapped in a cavity that is formed between the opposed end of threaded stud 74 and the inner end of cap member 70. Stem 72 projects from generally annular disk 76 through the end of cap member 70. Eye 78 is adapted to receive a clevis pin to which a lifting loop is mounted.

In the embodiments, which have been selected for purposes of illustration, the hoist ring or lifting loop is capable of continuous swivel about a longitudinal axis 52 and can also pivot approximately 180 degrees. The present invention can easily be adapted for use with a wide variety of lifting loop assemblies.

What have been described are preferred embodiments in which modifications and changes may be made without departing from the spirit and scope of the accompanying claims. Obviously, many modifications and variations of the present invention are possible in light of the above teachings. It is therefore to be understood that, within the scope of the appended claims, the invention may be practiced otherwise than as specifically described.

What is claimed is:

1. A hoist ring mount welded a surface of an object to be lifted, and to rotatably and pivotally mounting a lifting loop assembly, said hoist ring mount comprising:

a flange portion and a generally cylindrical bearing portion, said generally cylindrical bearing portion having a distal end a proximal end and an axis extending therebetween, said flange portion being integral with and extending generally radially outwardly from said proximal end and having an obverse face and an opposed reverse face, said obverse and reverse faces being peripherally joined by a perimeter portion, said obverse face being positioned against said surface, said perimeter portion being weldably attached to said surface to form a welded attachment wherein said welded attachment is the only attachment between said hoist ring mount and said object, said lifting loop assembly being detachably and rotatably mounted to said bearing portion.

2. A hoist ring mount of claim 1 wherein said lifting loop assembly is detachably and rotatably mounted to said bearing portion by an internally threaded member.

3. A hoist ring mount of claim 1 wherein said lifting loop assembly is detachably and rotatably mounted to said bearing portion by an externally threaded member.

4. A hoist ring mount of claim 1 wherein said lifting loop assembly is detachably and rotatably mounted to said bearing portion by a detent engaging element.

5. A hoist ring mount of claim 1 wherein said reverse face includes a loop retaining element.

6. A hoist ring mount of claim 1 wherein said generally cylindrical bearing portion has a peripheral bearing boundary, the length of said perimeter portion being greater than the length of said peripheral bearing boundary.

7. A hoist ring mount of claim 6 wherein the length of said perimeter portion is at least twice the length of said peripheral bearing boundary.

8. A hoist ring assembly comprising:

a lifting loop assembly including a lifting loop member and a collar member, said lifting loop member being pivotally engaged with said collar member; and a hoist ring mount including a flange portion and a generally cylindrical bearing portion, said hoist ring mount being adapted to detachably and rotatably mount said collar member on said generally cylindrical bearing portion, said bearing portion having a distal end, a proximal end, and an axis extending therebetween, said flange portion being integral with and extending generally radially outwardly from said proximal end and having an obverse face and an opposed reverse face, said obverse and reverse faces being peripherally joined by a perimeter portion, said obverse face being positioned against a surface, and said perimeter portion being weldably attached to said surface.

* * * * *